US008807245B2

(12) United States Patent
Scott et al.

(10) Patent No.: US 8,807,245 B2
(45) Date of Patent: Aug. 19, 2014

(54) REAMING TOOL

(75) Inventors: Edward D. Scott, Cardenden (GB); Lance S. Davis, Aberdeen (GB)

(73) Assignee: Deep Casing Tools, Ltd., Aberdeen (GB)

( * ) Notice: Subject to any disclaimer, the term of this patent is extended or adjusted under 35 U.S.C. 154(b) by 454 days.

(21) Appl. No.: 12/978,435

(22) Filed: Dec. 24, 2010

(65) Prior Publication Data

US 2011/0168447 A1 Jul. 14, 2011

Related U.S. Application Data

(63) Continuation of application No. PCT/GB2009/001601, filed on Jun. 26, 2009.

(51) Int. Cl.
*E21B 4/00* (2006.01)

(52) U.S. Cl.
USPC ..... 175/107; 384/138

(58) Field of Classification Search
CPC ..... E21B 4/02; E21B 10/26; E21B 4/003; E21B 7/068
USPC ..... 175/57, 104, 107, 92; 277/541; 384/130, 138, 151, 477
See application file for complete search history.

(56) References Cited

U.S. PATENT DOCUMENTS

| | | | | |
|---|---|---|---|---|
| 2,937,008 | A * | 5/1960 | Whittle | 415/65 |
| 4,059,165 | A * | 11/1977 | Clark | 175/107 |
| 4,060,141 | A | 11/1977 | Catterfeld | |
| 5,785,509 | A | 7/1998 | Harris et al. | |
| 2003/0056990 | A1 | 3/2003 | Oglesby | |
| 2003/0079640 | A1 * | 5/2003 | Beatson et al. | 104/106 |
| 2005/0183892 | A1 * | 8/2005 | Oldham et al. | 175/402 |
| 2006/0237234 | A1 | 10/2006 | Dennis | |

FOREIGN PATENT DOCUMENTS

| | | | |
|---|---|---|---|
| WO | 2006069177 | A2 | 9/2006 |
| WO | 2008015402 | A2 | 2/2008 |

OTHER PUBLICATIONS

Novelty Search Report, British patent application No. GB0811809.3, Feb. 8, 2008.

International Preliminary Report of Patentability, International Application PCT/GB2009/001601.

* cited by examiner

*Primary Examiner* — Shane Bomar
*Assistant Examiner* — Kipp Wallace
(74) *Attorney, Agent, or Firm* — Richard A. Fagin

(57) ABSTRACT

A reaming tool for use in reaming a bore includes a body adapted for location in a bore. The body defines a rotor of a rotary drive arrangement. A shaft adapted for location is disposed in the body. The shaft defines a stator of the rotary drive arrangement. A seal element is disposed between the shaft and the body. The seal element defines a bearing surface for permitting sealed relative rotation of the rotary drive arrangement. The tool includes a reaming member, wherein relative rotation between the body and the shaft facilitates reaming of the bore by the reaming member.

17 Claims, 2 Drawing Sheets

REAMING TOOL

CROSS REFERENCE TO RELATED APPLICATIONS

This is a continuation of International Application No. PCT/GB/2009/01601 filed on 26 Jun. 2009. Priority is claimed from British Patent Application No. GB 0811809.3 filed on 27 Jun. 2008.

STATEMENT REGARDING FEDERALLY SPONSORED RESEARCH OR DEVELOPMENT

Not Applicable

FIELD OF THE INVENTION

This invention relates to a reaming tool and, in particular, but not exclusively, to a reaming tool for use in a bore, such as a wellbore or the like.

BACKGROUND TO THE INVENTION

In the oil and gas industry, in order to access hydrocarbon-bearing or geothermal formations, one or more bores may be drilled from surface, the bores typically being lined with sections of metal tubes, known as casings. A number of casings are coupled together as a casing string, the string being run into the bore substantially without rotation. The annulus between the casings and the bore is subsequently filled and sealed with cement to secure the casings in place.

When running the string into the bore, the string commonly encounters obstructions in the bore including, for example, ledges extending into the bore, partially collapsed regions of a formation, or drill cuttings lying on the lower side of an inclined bore, whereby the bore obstructions may prevent or limit further formation, completion or operation of the bore. In order to improve the surface texture and geometric tolerances of the bore, a reaming tool may be attached to a leading end of the string and run into the bore to facilitate removal of the obstructions, this known as a reaming-with-casing operation. The casing string is reciprocated and/or rotated from surface to permit a reaming operation to be performed. However, casings and casing couplings are generally not suited to transferring torque and rotation of the casing string may be limited. Furthermore, rotating the casing string greatly complicates the drive and coupling arrangements required at surface.

SUMMARY OF THE INVENTION

According to a first aspect of the present invention, there is provided a reaming tool for use in reaming a bore, the tool comprising:

a body adapted for location in a bore, the body defining a rotor of a rotary drive arrangement;

a shaft adapted for location in the body, the shaft defining a stator of the rotary drive arrangement;

a seal element adapted for location between the shaft and the body, the seal element adapted to define a bearing surface for permitting sealed relative rotation of the rotary drive arrangement; and a reaming member, wherein relative rotation between the body and the shaft facilitates reaming of the bore by the reaming member.

According to a second aspect of the present invention there is provided a method of reaming a bore, the method comprising the steps:

locating a tool in a bore to be reamed, the tool comprising:

a body defining a rotor of a rotary drive arrangement;

a shaft adapted for location in the body, the shaft defining a stator of the rotary drive arrangement;

a seal element adapted for location between the shaft and the body and adapted to define a bearing surface for permitting sealed relative rotation of the rotary drive arrangement; and a reaming member; and operating the rotary drive arrangement to permit reaming of the bore by the reaming member.

According to a third aspect of the present invention there is provided a tubular string assembly comprising a reaming tool according to the first embodiment of the present invention.

According to a fourth aspect of the present invention there is provided a seal element for use in a sealing a rotary connection, the seal element adapted to permit sealed relative rotation of the rotary connection. The seal element may comprise a substrate manufactured, for example, from aluminium, aluminium alloy, phosphor bronze, ceramic or other suitable material, the substrate having a layer or coating of hard material. The coating may comprise a tungsten, carbide or cobalt or other hard material.

According to a fifth aspect of the present invention, there is provided a reaming tool for use in reaming a bore, the tool comprising:

a body adapted for location in a bore, the body defining a rotor of a rotary drive arrangement;

a shaft adapted for location in the body, the shaft defining a stator of the rotary drive arrangement; and a reaming member, wherein relative rotation between the body and the shaft facilitates reaming of the bore by the reaming member.

According to a sixth aspect of the present invention there is provided a method of reaming a bore, the method comprising the steps:

locating a tool in a bore to be reamed, the tool comprising a body defining a rotor of a rotary drive arrangement; a shaft adapted for location in the body, the shaft defining a stator of the rotary drive arrangement; and a reaming member; and operating the rotary drive arrangement to permit reaming of the bore by the reaming member.

According to another aspect of the present invention there is provided a tubular string assembly comprising a reaming tool according to the fifth embodiment of the present invention.

BRIEF DESCRIPTION OF THE DRAWINGS

These and other aspects of the present invention will now be described with reference to the accompanying drawings in which.

DETAILED DESCRIPTION

Figure 1:
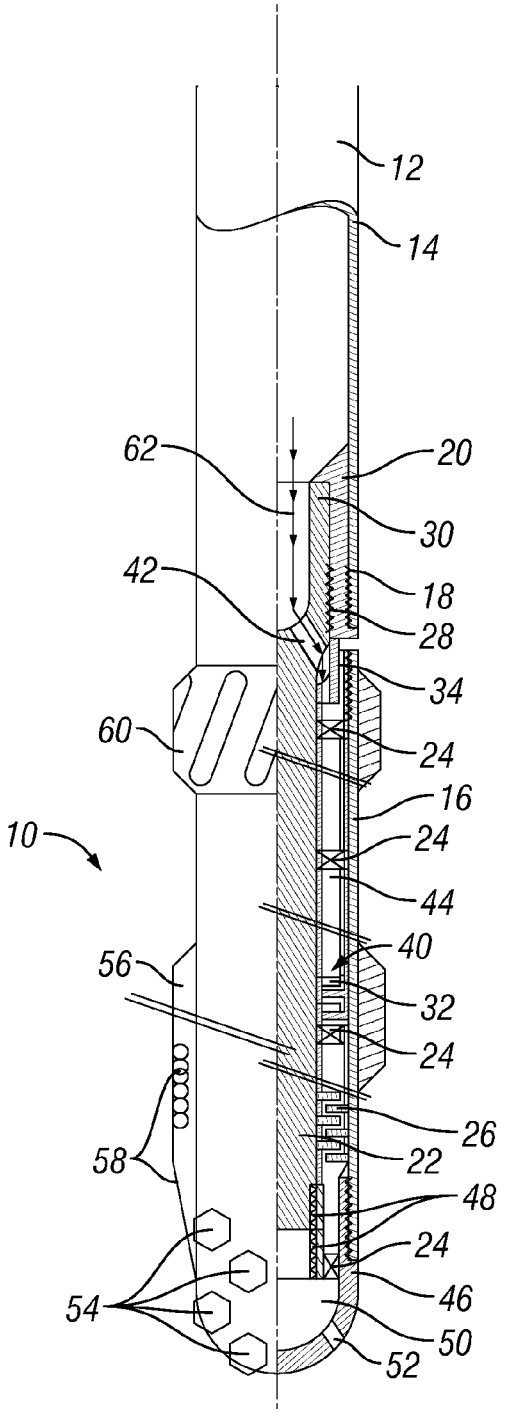
FIG. 1 is a partial longitudinal sectional view of a reaming tool according to an embodiment of the present invention.

The various aspects of the present invention will first be described in general terms, to be followed by a more detailed description with specific reference to the drawings.

According to a first aspect of the present invention, there is provided a reaming tool for use in reaming a bore, the tool comprising:

a body adapted for location in a bore, the body defining a rotor of a rotary drive arrangement;

a shaft adapted for location in the body, the shaft defining a stator of the rotary drive arrangement;

a seal element adapted for location between the shaft and the body, the seal element adapted to define a bearing surface for permitting sealed relative rotation of the rotary drive arrangement; and a reaming member, wherein relative rotation between the body and the shaft facilitates reaming of the bore by the reaming member.

A tool according to embodiments of the present invention permits relatively high speed rotation of the reaming member relative to a tubular component, such as a casing string, to which the tool may be coupled. For example, the body may be adapted to rotate at a rotational speed that would likely result in damage to at least one of the tubular component, the tubular couplings and the tool.

The rotary drive arrangement may be of any suitable form. For example, the rotary drive arrangement may comprise at least one of a fluid turbine, axial vane hydraulic motor, a positive displacement motor, an electric motor or any other suitable rotary drive. In particular embodiments, the tool may be fluid driven, the tool defining a fluid conduit for directing fluid through the rotary drive arrangement to drive rotation of the rotary drive arrangement.

In particular embodiments, the shaft may be held stationary and the body may be adapted for rotation relative to the shaft. For example, the shaft may be coupled to the tubular component, such as the casing string and the shaft may be held stationary by the casing string. Alternatively, both the body and the shaft may be adapted for relative rotation, and in particular embodiments, the shaft may be adapted for rotation in an opposing direction to rotation of the body.

The shaft and the body may be operatively coupled by at least one bearing. For example, the tool may comprise a radial bearing for mounting the shaft to the body and, in particular embodiments, a plurality of radial bearings may be provided. Alternatively, or in addition, the tool may comprise at least one thrust bearing for restraining relative axial movement of the body and the shaft.

The tool may further comprise a nose forming a leading end of the tool. The nose may be formed on, or coupled to, the body and may be adapted for rotation with the body to facilitate reaming of the bore. Alternatively, the nose may be formed on, or coupled to, the shaft and may be adapted for rotation and/or reciprocation with the shaft to permit reciprocal reaming or stabbing through bore obstructions and the like. The nose may further comprise at least one fluid port for permitting fluid to be directed to the exterior of the tool. The provision of a port permits fluid, such as drilling fluid, mud or the like, to be directed through the tool to assist in the removal and/or displacement of obstructions from the bore. In particular embodiments, at least one of the ports may define, or provide mounting for, a nozzle. For example, the fluid port may be adapted to direct fluid from the fluid conduit out from the tool to facilitate removal of obstructions by jetting. At least one of the ports may be integrally formed in the nose. Alternatively, at least one of the ports may comprise a separate component coupled to the nose. The nozzle may be constructed from any suitable material, including a ferrous metal, non-ferrous metal or a material such as ceramic or machinable glass.

The reaming member may be of any suitable form. For example, the tool may comprise a single reaming member. Alternatively, the tool may comprise a plurality of reaming members.

The reaming member may, for example, comprise a rib, blade, projection or the like. Alternatively, or in addition, the reaming member may comprise at least one cutting or grinding element, for example polycrystalline diamond compact (PDC) cutters, carbide particles or other element or surface suitable for assisting in performing the reaming operation.

In particular embodiments, the reaming member may be formed on, or coupled to, the body and may be arranged to engage the bore to facilitate reaming of the bore. For example, the reaming member may extend around at least a portion of the circumference of the body and may extend in a spiral, helical, serpentine, or other configuration. Alternatively, the reaming member may extend axially relative to the body.

Alternatively, or in addition, the reaming member may be provided on the nose. For example, the nose may comprise at least one of a rib, blade, projection or the like, a cutting or grinding element, polycrystalline diamond compact (PDC) cutter, carbide particle or other element or surface suitable for assisting in performing the reaming operation.

The seal element is adapted for location between the shaft and the body and is adapted to permit sealed relative rotation between the shaft and the body. In particular embodiments, the seal element may comprise a substrate, for example, manufactured from aluminium, aluminium alloy, phosphor bronze, ceramic or any other suitable substrate material, the substrate having a layer or coating of hard material. The coating may comprise at least one of tungsten, carbide or cobalt or other hard material.

The tool may further comprise at least one stabiliser. The stabiliser may be adapted to assist in maintaining the radial position of the tool relative to the bore, for example, to facilitate a cementing operation or the like in the bore.

The tool may be constructed from any suitable material or combination or materials, including for example a metallic material or alloy, a ceramic material, a polymeric material, a glass material, a laminate material, a carbon fibre material or other suitable material or combination of materials. At least part of the tool may be adapted to facilitate drilling through the tool. For example, at least one of the body, shaft, nose, reaming element, bearing, seal element and fluid port may be constructed from a readily drillable material which may be frangible or otherwise adapted to break. In particular embodiments, at least part of the tool may be constructed from an aluminium, ceramic, polymeric or carbon fibre material, though any other suitable material may be used.

According to a second aspect of the present invention there is provided a method of reaming a bore, the method comprising the steps:

locating a tool in a bore to be reamed, the tool comprising:

a body defining a rotor of a rotary drive arrangement;

a shaft adapted for location in the body, the shaft defining a stator of the rotary drive arrangement;

a seal element adapted for location between the shaft and the body and adapted to define a bearing surface for permitting sealed relative rotation of the rotary drive arrangement; and a reaming member; and operating the rotary drive arrangement to permit reaming of the bore by the reaming member.

The method may further comprise directing fluid, such as drilling fluid, drilling mud or the like, through the rotary drive arrangement to drive rotation of the rotary drive arrangement. For example, the method may comprise directing fluid through the rotary drive arrangement to drive rotation of the body relative to the shaft. Alternatively, or in addition, the method may comprise rotating the shaft, for example, by directing fluid through the rotary drive arrangement. Alternatively, the shaft may be coupled to a tubular component, such as a bore-lining tubular string, the shaft being rotated with rotation of the tubular string.

According to a third aspect of the present invention there is provided a tubular string assembly comprising a reaming tool according to the first embodiment of the present invention.

According to a fourth aspect of the present invention there is provided a seal element for use in a sealing a rotary connection, the seal element adapted to permit sealed relative rotation of the rotary connection. The seal element may comprise a substrate manufactured, for example, from aluminium, aluminium alloy, phosphor bronze, ceramic or other suitable material, the substrate having a layer or coating of hard material. The coating may comprise a tungsten, carbide or cobalt or other hard material.

According to a fifth aspect of the present invention, there is provided a reaming tool for use in reaming a bore, the tool comprising:

a body adapted for location in a bore, the body defining a rotor of a rotary drive arrangement;

a shaft adapted for location in the body, the shaft defining a stator of the rotary drive arrangement; and a reaming member, wherein relative rotation between the body and the shaft facilitates reaming of the bore by the reaming member.

According to a sixth aspect of the present invention there is provided a method of reaming a bore, the method comprising the steps:

locating a tool in a bore to be reamed, the tool comprising a body defining a rotor of a rotary drive arrangement; a shaft adapted for location in the body, the shaft defining a stator of the rotary drive arrangement; and a reaming member; and operating the rotary drive arrangement to permit reaming of the bore by the reaming member.

According to another aspect of the present invention there is provided a tubular string assembly comprising a reaming tool according to the fifth embodiment of the present invention.

Referring initially to FIG. 1 of the drawings, there is shown a partial longitudinal sectional view of a reaming tool 10 according to a first embodiment of the present invention. The tool 10 is adapted for location in a bore (not shown).

In the embodiment shown in FIG. 1, the tool 10 is adapted to be coupled to a tubular component, such as casing 12, via a connector in the form of crossover sub 14, though it will be understood that any suitable coupling may be used. The tool 10 comprises a body 16 coupled to the connector 14 by connection 18. A seal 20 is provided between the body 16 and the connector 14 to substantially prevent fluid leakage between the connector 14 and the body 16. A shaft 22 is mounted within the body 16 on radial bearings 24 and a thrust bearing 26 is provided to axially restrain the shaft 22 relative to the body 16. The shaft 22 is coupled to the body 16 by a connection 28 and a seal 30 is provided between the shaft 18 and the body 16 to substantially prevent fluid leakage therebetween.

As shown in FIG. 1, the body 16 defines a stator and the shaft 22 defines a rotor such that the shaft 22 and the body 16 together define a rotary drive arrangement 32.

Figure 1A:
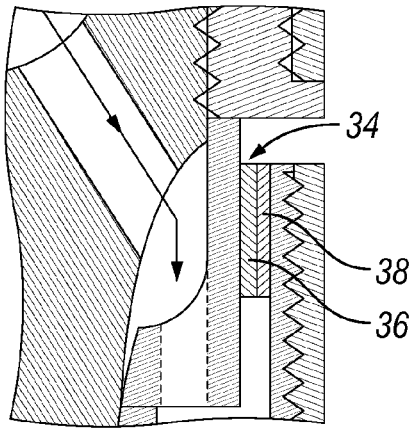
FIG. 1A shows an enlarged view of a rotary seal.

A rotary seal 34 is also provided between the body 16 and the shaft 22, the rotary seal 34 adapted to permit relative rotation between the body 16 and the shaft 22 while substantially preventing fluid leakage therebetween. In reference also to FIG. 1A which shows an enlarged view of the rotary seal 34, the rotary seal 34 comprises a substrate 36 of aluminium, though other materials may be used where appropriate. The substrate has a hard coating 38 comprising a mixture of tungsten, carbide and cobalt, though other hard materials may be used, for example a coating applied by a high velocity oxygen fuel process. In the embodiment shown in FIG. 1A, the coating 38 has a thickness of about 6 to 10 thousands of an inch (0.15 to 0.25 mm). For the purpose of illustration, the coating thickness has been exaggerated in FIG. 1A. The rotary seal 34 provides a sealing surface during relative rotation between the shaft 22 and the body 16.

The tool 10 comprises a fluid conduit 40, a first portion 42 of the conduit 40 located within the shaft 22 and a second portion 44 located within the body 16. The fluid conduit 40 is arranged to direct fluid through the tool 10 and through the rotary drive arrangement 32 defined by the body 16 and the shaft 22 to drive relative rotation therebetween.

The tool 10 further comprises a nose 46 coupled to the body 16 and the shaft by locking nuts 48. The nose 46 defines a bore 50 adapted to receive fluid exiting from the rotary drive arrangement 32, the nose 46 directing the fluid to the exterior of the tool 10 via a nozzle 52. The provision of a nozzle 52 permits jetting of the bore to assist in the removal of wellbore obstructions (not shown). The outer surface of the nose 46 provides mounting for ceramic cutting and grinding elements 54 which facilitate reaming of the bore.

The tool 10 further comprises a reaming rib or blade 56 arranged to permit reaming of the bore. The blade 56 also comprises ceramic cutting and grinding elements 58 to assist in the reaming operation.

A stabiliser 60 is also provided on an exterior of the body 16, the stabiliser 60 configured to assist in directing the tool 10 through the wellbore. In the embodiment shown, a single stabiliser 60 is shown, though any number of stabilisers 60 may be provided where required.

In use, fluid in the form of drilling mud or other drilling fluid (shown by arrow 62) is directed through the connector 14 to fluid conduit portion 42 in the shaft 22 to the fluid conduit portion 44 in the body 16. The rotary seal 34 substantially prevents leakage of the fluid between the body 16 and the shaft 22. The fluid is then directed to the rotary drive arrangement 32 defined by the body 16 and the shaft 18. In the embodiment shown, the rotary drive arrangement 32 comprises a fluid turbine, the body 16 defining stator and the shaft 22 defining a rotor. As fluid is directed through the rotary drive arrangement 32, the shaft 22 rotates relative to the body 16 to facilitate reaming of the bore.

Figure 2:
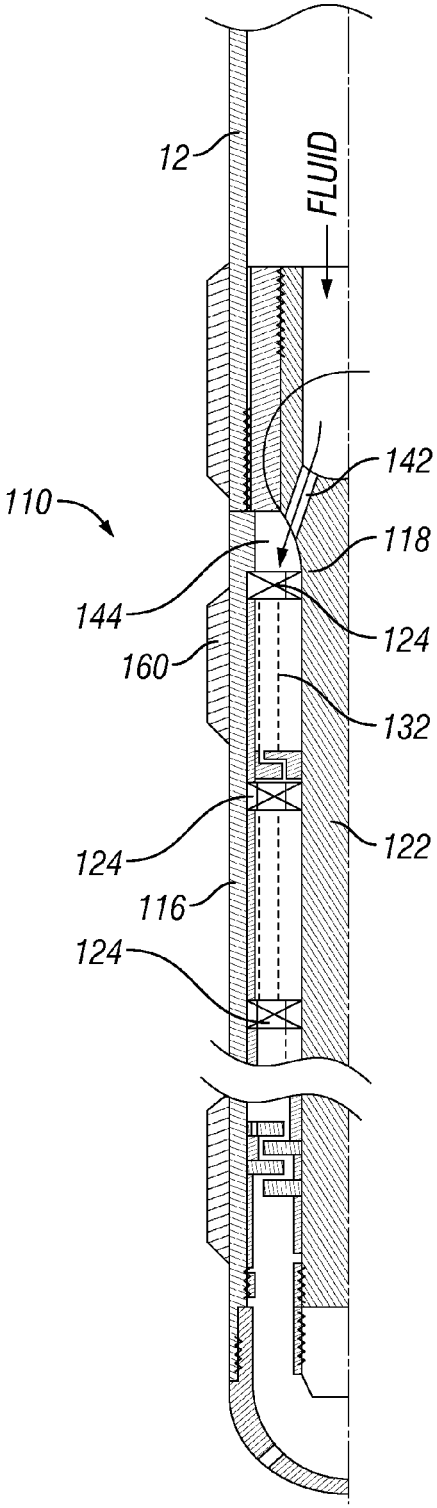
FIG. 2 is a partial longitudinal sectional view of a reaming tool according to another embodiment of the present invention.

Referring now to FIG. 2 of the drawings, there is shown a partial longitudinal sectional view of a reaming tool 110 according to another embodiment of the present invention. The second embodiment shares many of the components of the first embodiment of the present invention and like components are shown by like numerals increments by 100. In the embodiment shown in FIG. 2, the stator and rotor and reversed, whereby the body 116 defines a rotor and the shaft 122 defines a stator. The external body 116 is adapted to rotate on substantially stationary shaft 122 to permit reaming of the wellbore.

In use, fluid in the form of drilling mud or other drilling fluid is directed through fluid conduit portion 142 in the shaft 122 to the fluid conduit portion 144 in the body 116. The fluid is then directed to the rotary drive arrangement 132 defined by the body 116 and the shaft 118. In the embodiment shown in FIG. 2, the rotary drive arrangement 132 comprises a fluid turbine, the body 116 defining a rotor and the shaft 122 defining a stator. As fluid is directed through the rotary drive arrangement 132, the body 116 rotates relative to the shaft 122 to facilitate reaming of the bore.

It should be understood that the embodiments described are merely exemplary of the present invention and that various modifications may be made without departing from the scope of the invention.

For example, it will be understood that both the body and the shaft may be adapted for relative rotation in opposite directions, where required.

What is claimed is:

1. A reaming tool for use in reaming a bore, the tool comprising:

a body adapted for location in a bore, the body defining at least one of a rotor and a stator of a rotary drive arrangement;

a shaft adapted for location in the body, the shaft defining the other of a stator and a rotor of the rotary drive arrangement;

a seal element adapted for location between the shaft and the body, the seal element adapted to define a sealing surface for permitting sealed relative rotation of the rotary drive arrangement, wherein the seal element defines a plain bearing a fluid conduit formed inside the body and in the shaft configured to direct substantially all fluid flow through the reaming tool to the rotary drive arrangement to cause rotation thereof; and a reaming member, wherein relative rotation between the body and the shaft facilitates reaming of the bore by the reaming member.

2. The reaming tool of claim 1, wherein the seal element comprises a substrate having a coating of hard material.

3. The reaming tool of claim 2, wherein at least one of:

the substrate comprises at least one of: aluminium; aluminium alloy; phosphor bronze; and ceramic material;

the coating comprises at least one of: tungsten; carbide; and cobalt; and the coating is adapted to be applied by a high velocity oxygen fuel process.

4. The reaming tool of claim 1, wherein the rotary drive arrangement comprises at least one of: a fluid turbine; an axial vane hydraulic motor; a positive displacement motor; an electric motor.

5. The reaming tool of claim 1, wherein at least one of:

the shaft is adapted to be held stationary and the body is adapted for rotation relative to the shaft; and the body and the shaft are adapted for relative rotation.

6. The reaming tool of claim 1, wherein the body and the shaft are adapted for relative rotation, the shaft being adapted for rotation in an opposing direction to rotation of the body.

7. The reaming tool of claim 1, wherein the tool further comprises a nose forming a leading end of the tool.

8. The reaming tool of claim 7, wherein at least one of:

the reaming member is provided on the nose;

the nose is coupled to the body and is adapted for rotation with the body; and the nose is coupled to the shaft and is adapted for at least one of rotation and reciprocation with the shaft.

9. The reaming tool of claim 7, wherein the nose further comprises at least one fluid port for permitting fluid to be directed to the exterior of the tool.

10. The reaming tool of claim 9, wherein at least one of:

at least one of the ports defines a nozzle;

at least one of the ports is integrally formed with the nose; and at least one of the ports comprises a separate component coupled to the nose.

11. The reaming tool of claim 1, wherein the tool comprises at least one reaming member, and wherein the at least one reaming member comprises at least one of: a rib; a blade; a projection; a cutting element; a grinding element; a polycrystalline diamond compact cutter; and a carbide particle.

12. The reaming tool of claim 11, wherein the reaming member extends axially relative to the body.

13. The reaming tool of claim 11, wherein the reaming member extends around at least a portion of the circumference of the body.

14. The reaming tool of claim 11, wherein the reaming member extends in at least one of: a spiral configuration; a helical configuration; a serpentine configuration.

15. The reaming tool of claim 1, wherein the reaming tool is constructed from at least one of: a metallic material; a metal alloy; a ceramic material; a polymeric material; a glass material; a laminate material; and a carbon fibre material.

16. The reaming tool of claim 1, wherein at least part of the reaming tool is adapted to facilitate drilling through the tool, and wherein at least one of the body, the shaft, a nose, a reaming element, a bearing, a seal element and a fluid port are constructed from a drillable material.

17. The reaming tool of claim 1, further comprising a tubular string assembly coupled thereto.

* * * * *